US006073557A

United States Patent [19]

Hachiya et al.

[11] Patent Number: 6,073,557

[45] Date of Patent: Jun. 13, 2000

[54] INK SUPPLY UNIT FOR KEYLESS PRINTING PRESS

[75] Inventors: Tadashi Hachiya; Masahiko Miyoshi; Yukitoshi Takahashi, all of Kanagawa, Japan

[73] Assignee: Kabushiki Kaisha Tokyo Kikai Seisakusho, Tokyo, Japan

[21] Appl. No.: 09/078,852

[22] Filed: May 14, 1998

[30] Foreign Application Priority Data

Aug. 27, 1997 [JP] Japan ..... P9-231163

[51] Int. Cl.[7] ..... B41F 31/05; B41F 31/06

[52] U.S. Cl. ..... 101/365

[58] Field of Search ..... 101/365, 157, 101/169, 350.1, 363; 118/261

[56] References Cited

U.S. PATENT DOCUMENTS 984,913 2/1911 Hayes ..... 101/365
5,505,131 4/1996 Hachiya et al. ..... 101/365

FOREIGN PATENT DOCUMENTS 1-051344 11/1989 Japan .
6-166171 6/1994 Japan .
9-1780 1/1997 Japan .

*Primary Examiner*—J. Reed Fisher
*Attorney, Agent, or Firm*—Frishauf, Holtz, Goodman, Langer & Chick, P.C.

[57] ABSTRACT

An ink supply unit of a keyless printing press is capable of preventing leakage of an ink while printing is interrupted. The ink supply unit includes a movable blade provided between the both side plates in integral form, inclined descending toward a tip end side, supported on a base for movement toward and away from the peripheral surface of the fountain roller, driving means for driving the movable blade between a position where a tip end of the movable blade contacts to the peripheral surface of the fountain roller and a predetermined position where the tip end of the movable blade is located away from the peripheral surface of the fountain roller, and guide means coupled with the movable blade and guiding the movable blade so that the tip end of the movable blade moves with respect to the peripheral surface of the fountain roller with maintaining a predetermined attitude.

2 Claims, 7 Drawing Sheets

INK SUPPLY UNIT FOR KEYLESS PRINTING PRESS

BACKGROUND OF THE INVENTION

1. Field of the Invention

The present invention relates generally to a printing press which performs printing by supplying an ink having a relatively high viscosity to a surface of a plate on a plate cylinder. More specifically, the invention relates to an ink supply unit in a keyless printing press constantly supplying an ink in a uniform thickness over an entire surface of a plate, which ink supply unit may prevent the ink accumulated therein while printing is interrupted, from leaking between a tip end of a blade and a fountain roller.

2. Description of the Related Art

An ink supply unit of a keyless printing press adapted for an ink having a relatively high viscosity has been disclosed in Japanese Unexamined Patent Publication No. Heisei 9-1780, entitled "Ink supply unit". In the above-identified publication, two ink supply units are disclosed. One ink supply unit is an ink supply unit dedicated to keyless printing. As shown in FIG. 8, the ink supply unit is constructed with an inking roller contacting with a peripheral surface of a plate surface on a plate cylinder P a metering roller K contacting with a peripheral surface of the inking roller and having a plurality of fine depressions uniformly distributed on a peripheral surface thereof, a doctor means D scraping off an excessive ink from a peripheral surface of the metering roller K, an ink supply unit 1' opened at an upper portion and a front portion and formed with both side plates and a tilted base, a fountain roller 2 located at a position closing the front side of the ink supply unit 1' and having a peripheral surface located in the vicinity of a front end edge of the base across a first gap 11, even number of ink rollers disposed between the fountain roller 2 and the metering roller K, opposing with a peripheral surface of the fountain roller 2 across a second gap 13, mutually contacting peripheral surfaces, and contacting with the metering roller K, and a separated water receptacle 40 provided below the ink supply unit 1' and the fountain roller 2.

As disclosed in prior art, the ink is removed from the ink supply unit 1' by means of the fountain roller 2. The excessive ink is scraped off from the peripheral surface of the metering roller K for supplying the ink on the surface of the plate in a substantially uniform amount over the entire width thereof.

On the other hand, when the excessive ink is scraped off, an excessive dampening water supplied to the surface of the plate by a dampening unit S, is admixed. The excessive dampening water admixed to the ink is separated from the ink by a shearing force exerted on the ink while the ink is led out through the first and second gaps 11 and 13 and drops into the separated water receptacle 40.

Another ink supply unit disclosed in the above-identified publication is an ink supply unit adapted for both keyless printing and non-keyless printing. In addition to the similar construction to the ink supply unit illustrated in FIG. 8, as set forth above, switching means capable of switching the doctor means D between a state in which the ink can be scraped off and a state in which the ink cannot be scraped off, and adjusting means capable of adjusting size of the first gap independently for respective zones arbitrarily divided along the axial direction of the fountain roller 2, are provided so as to make it possible to perform both keyless printing and non-keyless printing.

When keyless printing is to be performed by the ink supply unit constructed as set forth above, the doctor means D is placed in the state contacting with the peripheral surface of the metering roller K by the switching means, and, in conjunction therewith, the size of the first gap 11 is set to be maximum by the adjusting means, for enabling the keyless printing. Namely, similar to the foregoing, the ink is led out by the fountain roller 2 from the ink supply unit 1', the excessive ink is scraped off from the peripheral surface of the metering ink by the doctor means D to supply the ink on the surface of the plate on the plate cylinder P in a substantially uniform amount over the entire width. On the other hand, when non-keyless printing is to be performed, the doctor means is placed in the state located away from the peripheral surface of the metering roller K by the switching means, and in conjunction therewith, the first gap is adjusted to be fully opened position per each separated zone for adjusting the amount of the ink to be removed. Then, the ink is led out from the ink supply unit 1' by the fountain roller 2 and supplied to the surface of the plate on the plate cylinder P for respectively adjusting the amount per respective zones with increasing fluidability of the ink by passing respective rollers located in opposition for cooperation.

In the case of the ink supply unit dedicated for keyless printing, the first gap 11 between the front edge of the ink supply unit 1' and the fountain roller 2 is invariable and is constantly opened. Therefore, while printing is interrupted, the stored ink leaks downwardly to frequently stain the peripheral components. Cleaning of such stain requires not an insignificant amount of work. Also, leakage inherently wastes the ink.

On the other hand, in the case of the ink supply unit for both keyless printing and non-keyless printing, the first gap 11 between the fountain roller 2 and the front edge of the base of the ink supply unit 1' is divided per divided zones along the axial direction of the fountain roller 2, and the adjusting means is provided for enabling independent adjustment of respective divided zones of the first gap.

When keyless printing is performed by the ink supply unit for both keyless printing and non-keyless printing, since the ink supply unit is used in the condition where the first gap 11 between the front edge of the base of the ink supply unit 1' and the peripheral surface of the fountain roller 2 are held open, the stored ink leaks downwardly to frequently stain the peripheral components, while printing is interrupted. In order to avoid leakage of the stored ink, it is possible to open and close the first gap 11 between the fountain roller 2 and the front edge of the base by the adjusting means per dividing zones to be used upon non-keyless printing.

However, the adjustment means for each divided zone inherently has a small and complicated operation mechanism. Furthermore, since the operation mechanism has to be provided for each divided zone, the adjustment means inherently becomes complicated and makes the production cost high. In addition, due to complicity of the mechanism and complicity of the means, frequency of occurrence of failure becomes high to make maintenance troublesome.

SUMMARY OF THE INVENTION

The present invention has been worked out in view of the problems encountered in the prior art, as set forth above. Therefore, it is an object of the present invention to provide an ink supply unit of a keyless printing press which can prevent leakage of an ink stored in the ink supply unit while printing is interrupted, to avoid wasting consumption of the ink due to leakage of the ink, and to avoid wasting work load for cleaning stain of the periphery due to leakage of the ink.

Another object of the present invention is to provide an ink supply unit which has a device for preventing leakage of the ink, which device has a simple mechanism and operation.

In order to accomplish the above-mentioned objects, according to one aspect of the invention, an ink supply unit of a keyless printing press, adapted for ink having a relatively high viscosity, with an opening in an upper portion and a front portion, and having both side plates, a base and a fountain roller located in the opened front portion and rotating with displacing a peripheral surface downwardly, comprises:

a movable blade provided between the both side plates in integral form, inclined descending toward a tip end side, supported on a base for movement toward and away from the peripheral surface of the fountain roller;

driving means for driving the movable blade between a position where a tip end of the movable blade contacts to the peripheral surface of the fountain roller and a predetermined position where the tip end of the movable blade is located away from the peripheral surface of the fountain roller; and guide means coupled with the movable blade and guiding the movable blade so that the tip end of the movable blade moves with respect to the peripheral surface of the fountain roller with maintaining a predetermined attitude.

The ink supply unit, set forth above, may further comprise auxiliary means coupled with the movable blade in a condition applicable of a force biasing the movable blade in one of moving direction thereof, for stabilizing the position of the tip end of the movable blade with respect to the peripheral surface of the fountain roller.

According to another aspect of the present invention, an ink supply unit of a keyless printing press, adapted for an ink having a relatively high viscosity, with an opening in an upper portion and a front portion, and having both side plates, a base and a fountain roller located in the opened front portion and rotating with displacing a peripheral surface downwardly, comprises:

a movable base provided between the both side plates in integral form, inclined descending toward a tip end side, supported on a base for movement toward and away from the peripheral surface of the fountain roller;

driving means connected to the movable base for driving the movable base between a position where a tip end of the movable base is placed in the vicinity of the peripheral surface of the fountain roller and a predetermined position where the tip end of the movable base is located away from the peripheral surface of the fountain roller;

guide means coupled with the movable base and guiding the movable base so that the tip end of the movable base moves with respect to the peripheral surface of the fountain roller with maintaining a predetermined attitude; and a tip end blade constituted of a plurality of members divided in an alignment direction of the both side plates, and mounted on the movable base with placing the tip ends of respective members in opposition to the peripheral surface of the fountain roller, and the members of the tip end blade being independently adjustable of contacting condition between the tip ends thereof and the peripheral surface of the fountain roller.

The ink supply unit may further comprise auxiliary means coupled with the movable base in a condition applicable of a force biasing the movable blade in one of moving directions thereof, for stabilizing the position of the tip end of the tip end blades mounted on the movable base with By operation of the driving means, the tip end blade is shifted between the position contacting with the peripheral surface of the fountain roller and the predetermined position away from the peripheral surface of the fountain roller. At this time, the movable base is guided by the guide means and is moved with maintaining the tip end at a predetermined attitude.

Furthermore, the movable blade or the tip end blade is applied a force in one of moving direction by the auxiliary means to stabilize the position of the tip end of the movable blade relative to the peripheral surface of the fountain roller.

Furthermore, in case of the ink supply unit of the keyless printing press, in which a plurality of tip end blades are mounted on the movable base, the tip end positions of the tip end blades relative to the peripheral surface of the fountain roller is finely adjusted adapting to deformation of the peripheral surface due to deflection or so forth, by individually adjusting the tip end blades with respect to the movable base.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
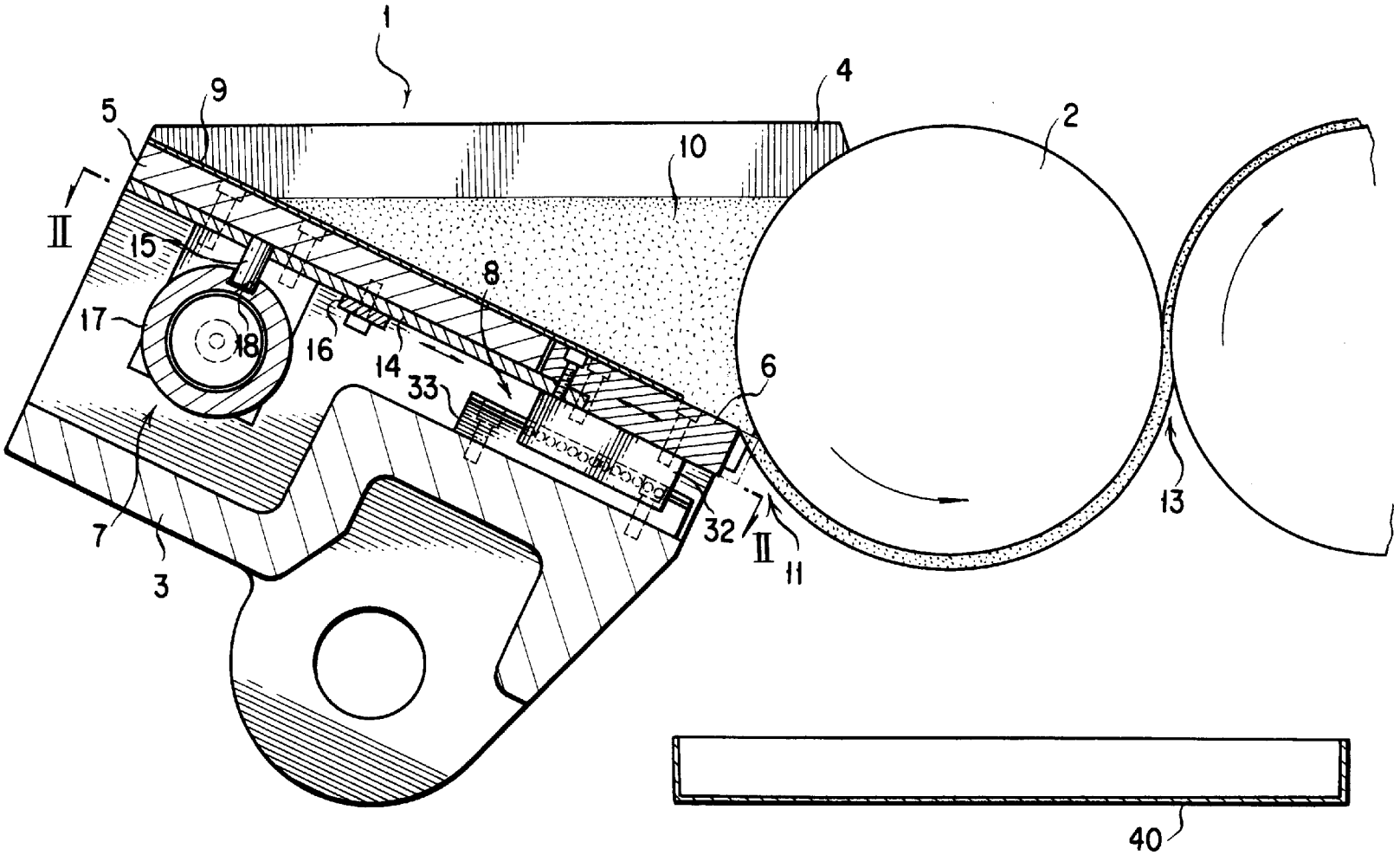
FIG. 1 is a sectional side elevation of the preferred embodiment of an ink supply unit according to the present invention.
Figure 2:
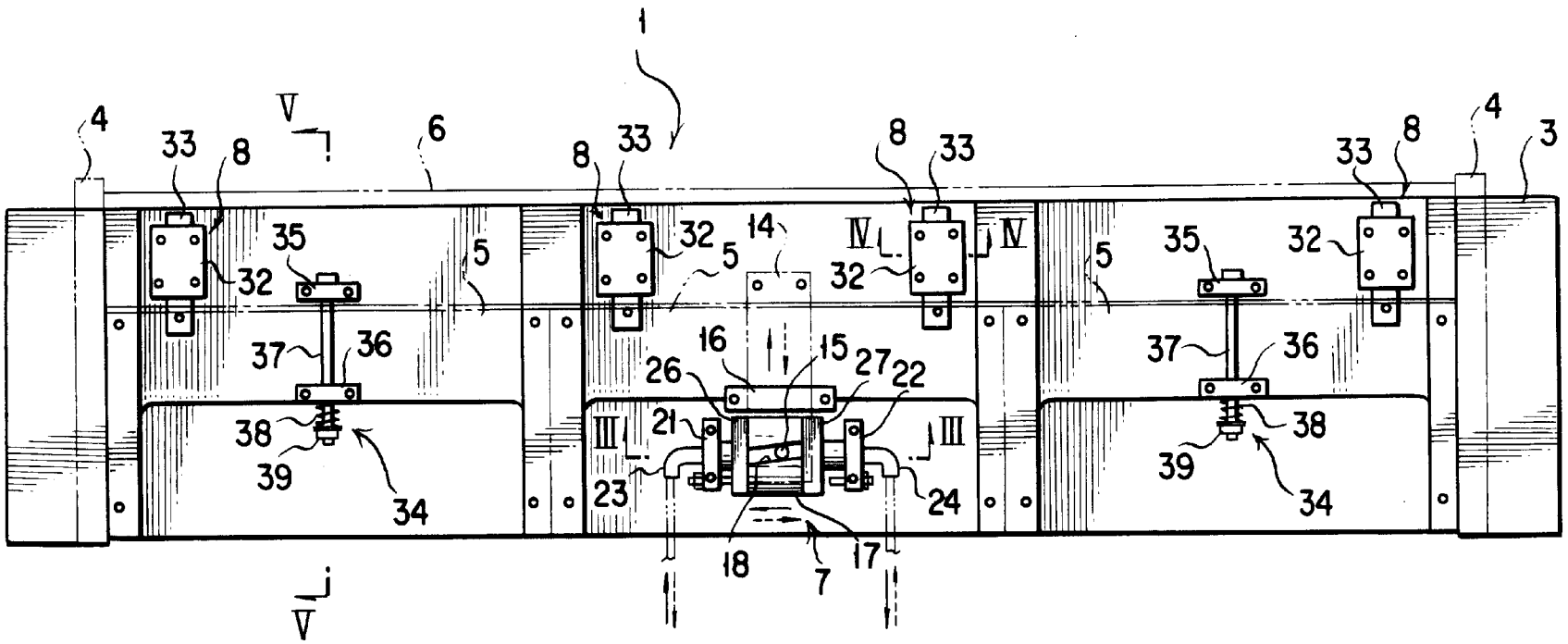
FIG. 2 is a section taken along line II—II of FIG. 1.
Figure 3:
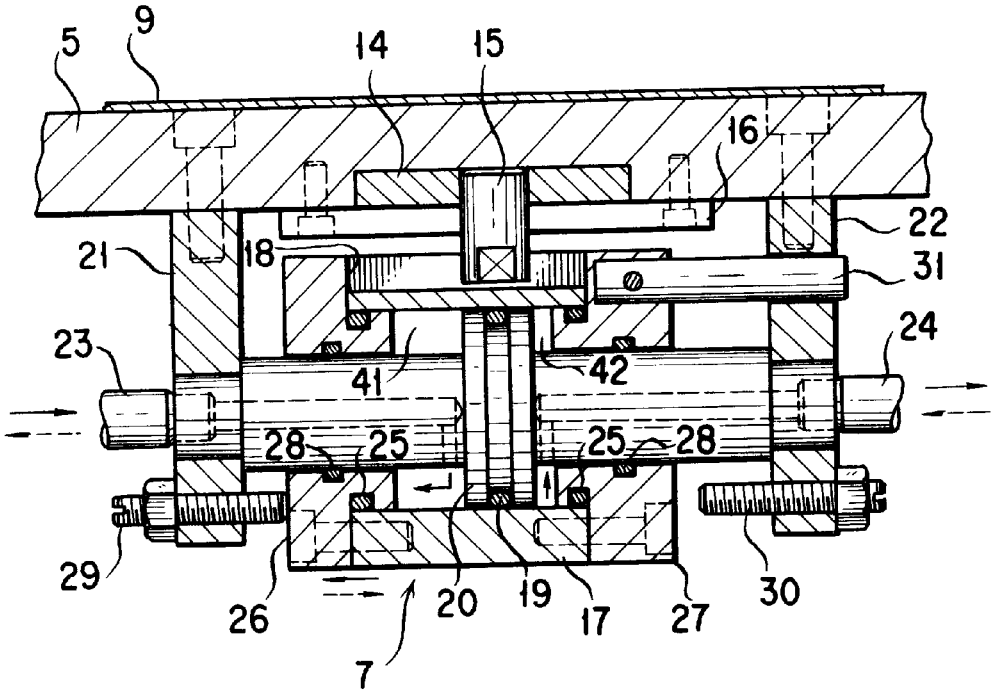
FIG. 3 is a section taken along line III—III of FIG. 2.
Figure 4:
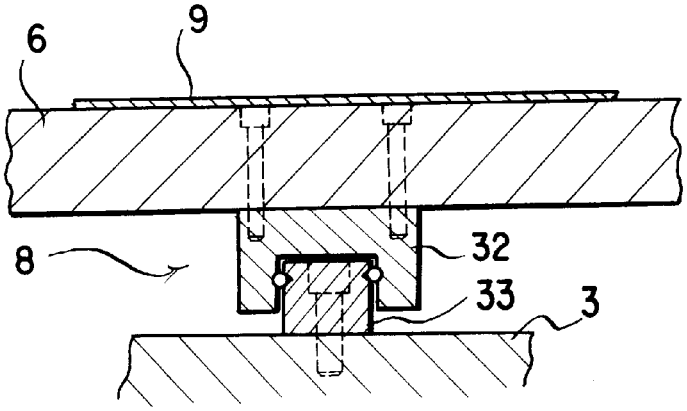
FIG. 4 is a section taken along line IV—IV of FIG. 2.
Figure 5:
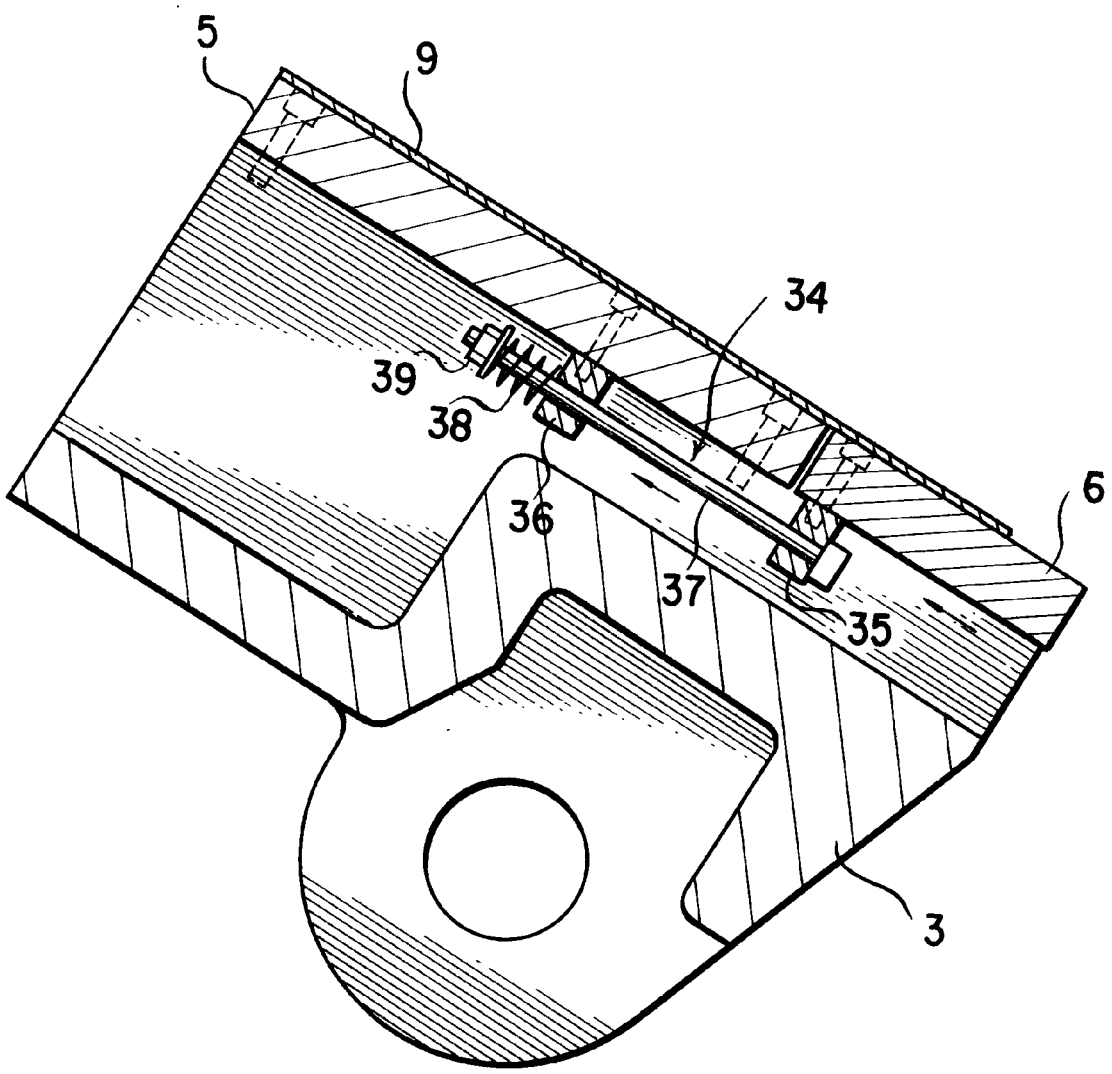
FIG. 5 is a section taken along line V—V of FIG. 2.
Figure 6:
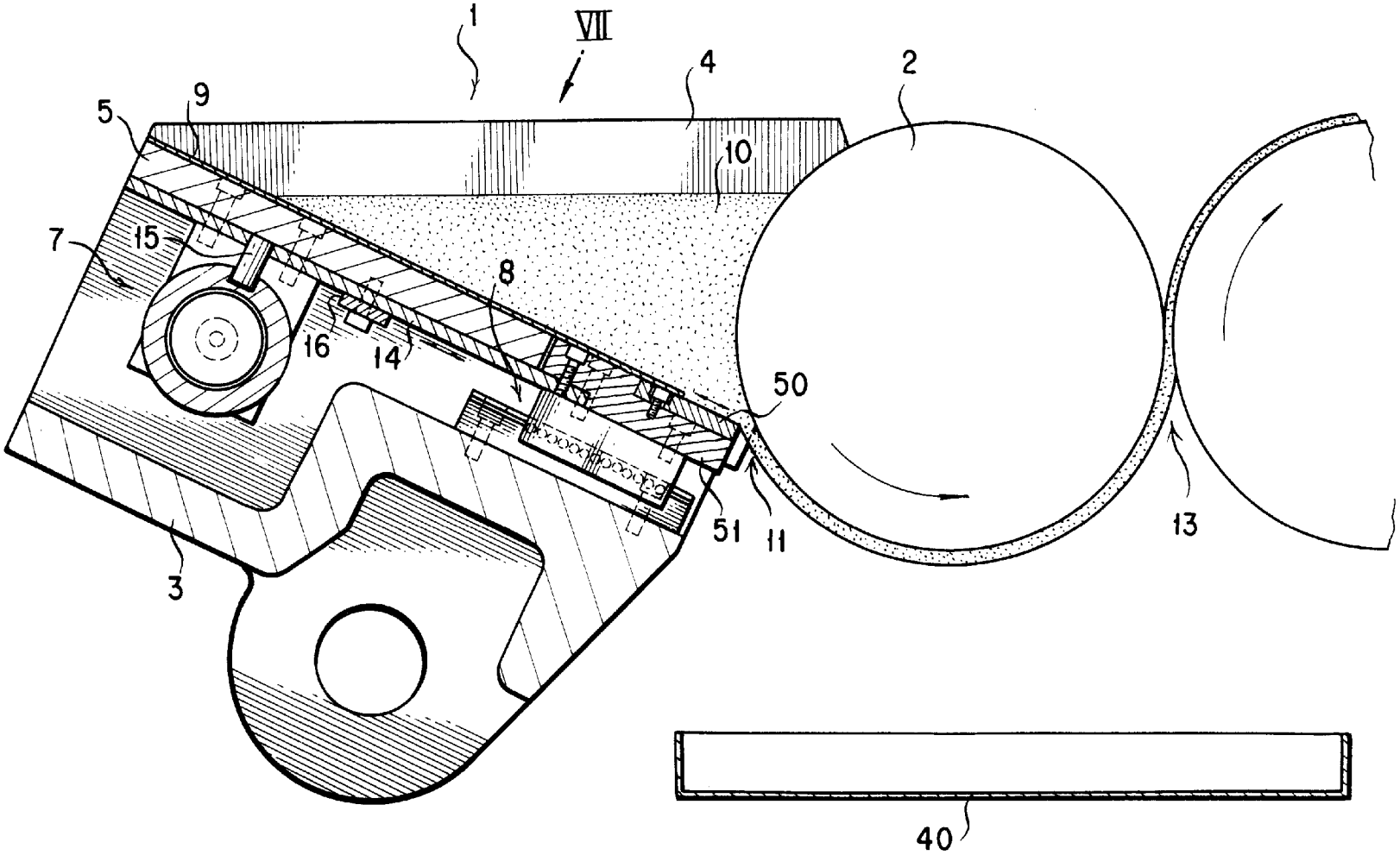
FIG. 6 is a sectional side elevation of another embodiment of an ink supply unit according to the present invention.
Figure 7:
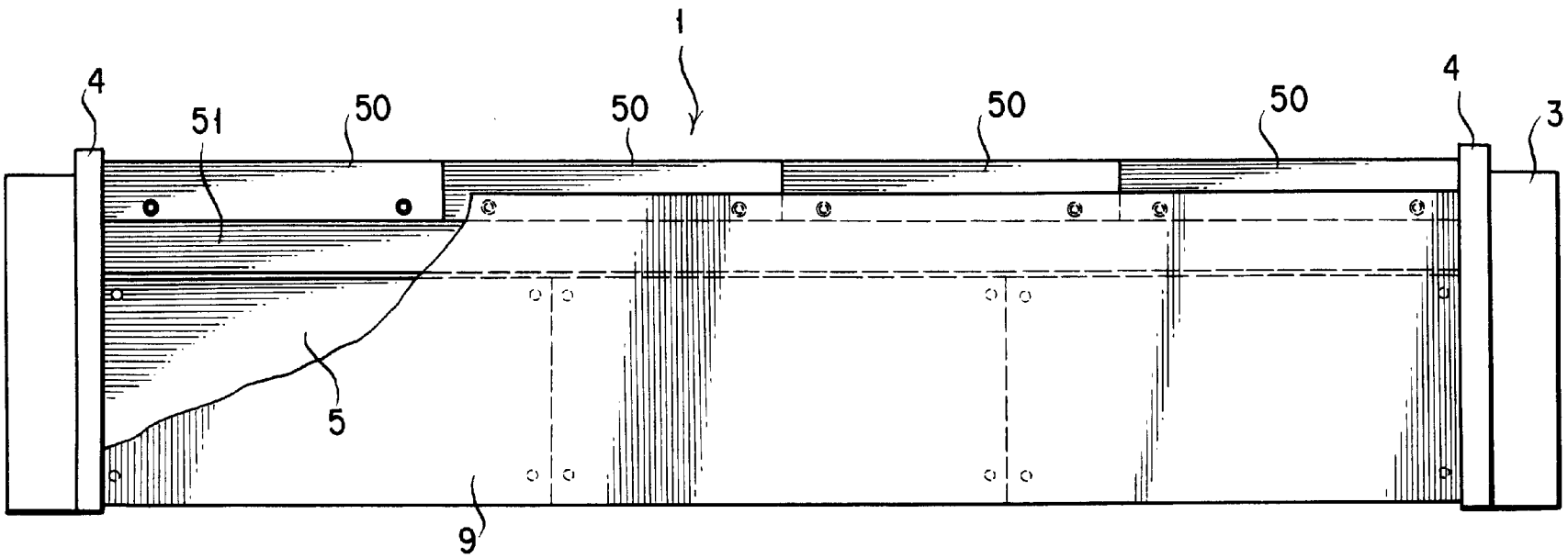
FIG. 7 is an illustration as viewed along an arrow VII of FIG. 6.
Figure 8:
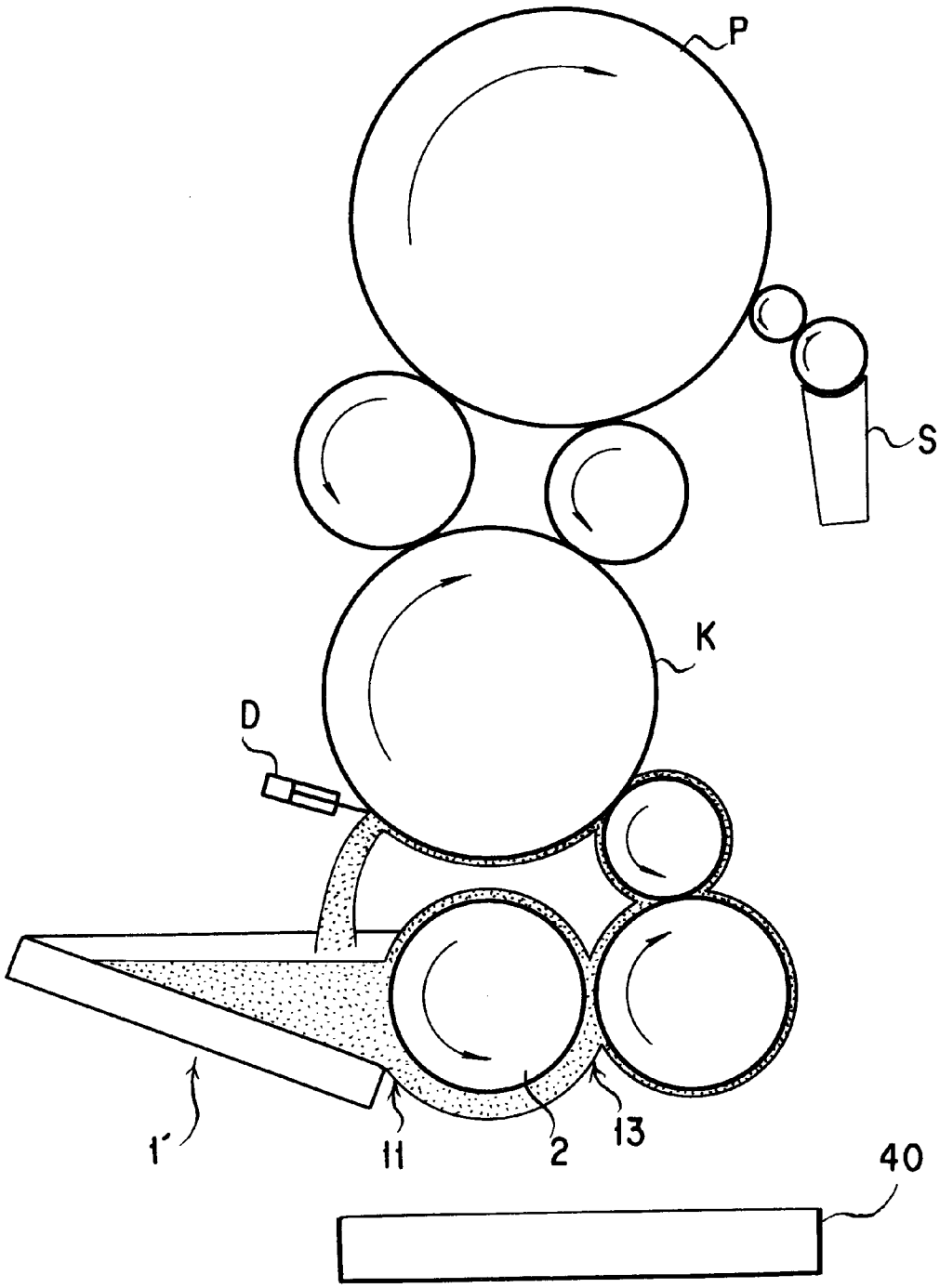
FIG. 8 is a sectional side elevation showing the conventional ink supply unit for a keyless printing press.

FIG. 1 is a sectional side elevation of the preferred embodiment of an ink supply unit according to the present invention, in which driving means of a movable blade and guide means are shown. FIG. 2 is a section taken along line II—II of FIG. 1. FIG. 3 is a section taken along line III—III of FIG. 2, which shows a detail of drive means of the movable blade. FIG. 4 is a section taken along line IV—IV of FIG. 2, which shows guide means for the movable blade. FIG. 5 is a section taken along line V—V of FIG. 2, which shows assisting means for moving the movable blade. FIG. 6 is a sectional side elevation of another embodiment of an ink supply unit according to the present invention, and FIG. 7 is an illustration as viewed along an arrow VII of FIG. 6. FIG. 8 is a sectional side elevation showing the conventional ink supply unit for a keyless printing press.

The ink supply unit of a keyless printing press, according to the present invention, is a replacement of the ink supply unit 1' of the keyless printing press shown in FIG. 8 set forth above.

As shown in FIG. 1, the ink supply unit 1 is constructed with a base 3 descending toward a peripheral surface of a fountain roller 2, side plates 4 defining both sides of a groove formed by the base 3 and a peripheral surface of the fountain roller 2, a base plate 5 provided on the upper portion of the descending base and integrally with the base 3 over both side plates 4 on the side away from the fountain roller 2, a movable blade 6 provided between the base plate 5 and the fountain roller, movable toward and away from the peripheral surface of the fountain roller 2, supported on the base 3 in such a manner that the upper surface thereof becomes the same surface configuration with the base plate 5, and integrally provided over the side plates 4, driving means 7 operable to move the movable blade 6 between a position to contact the tip end of movable blade 6 onto the peripheral surface of the fountain roller 2 and an arbitrary fixed position where the tip end is located away from the peripheral surface of the fountain roller 2, guide means guiding movement of the movable blade 6 with maintaining the tip end in parallel condition with the peripheral surface of the fountain roller 2, assisting means 34 stabilizing the position of the tip end of the movable blade 6 with respect to the peripheral surface of the fountain roller 2, and a thin plate form bottom plate 9 covering the base plate 5 mounted on the base 3 and the upper surface of the movable blade 6 and formed with a magnetic body fixed to the base plate 5. The driving means 7, the guide means 8 and the assisting means 34 are arranged within a space provided on the lower side of the base plate 5 and the movable blade 6.

In FIGS. 1, 2 and 3, there is shown the driving means of the movable blade 6 of the ink supply unit 1. On the lower surface of the central portion in the longitudinal direction of the movable blade 6 supported by the guide means 8 which will be discussed later, on the base 3, one end portion of a given width of a guide plate 14 is mounted. The guide plate 14 is provided in a condition extending toward the base plate 5. On the lower surface of the end portion, a pin 15 is fixedly projected downwardly.

On the lower surface of the center portion of the base plate 5 in the longitudinal direction, a groove is provided in a direction opposing to the peripheral surface of the fountain roller 2. The guide plate 14 is movably assembled in a direction opposing the peripheral surface of the fountain roller 2 with being restricted to both sides by the groove. On the other hand, so that the guide plate 14 will not be dropped off the groove of the base plate 5, a thin plate form support plate 16 mounted on the base plate 5 is supported.

As shown in FIG. 3, on the lower side of a pin 15 of the guide plate 14, a stepped shaft 20 having a given length of a larger diameter portion at the center portion in the longitudinal direction and smaller diameter portions on both sides, namely having a stepped larger diameter central portion, is provided with mounting respective end portions of both smaller diameter shaft portions on brackets 21 and 22 fixed on the lower surface of the base plate 5. Thus, the stepped shaft 20 extends in parallel to the axis of the fountain roller 2. On the outer peripheral surface of the larger diameter portion of the stepped shaft 20, sealing means 19 for contacting with the inner peripheral surface of the cylinder 17 which will be discussed later, is provided. Also, in both smaller diameter portions, blind bores extending along the axis from respective end faces of the stepped shaft 20 are provided. Each blind bore extends substantially through the smaller diameter portion and is communicated with a laterally extending bore which opens to the outer periphery of the smaller diameter portion in the vicinity of the larger diameter portion. In the blind bores in both end portions of the stepped shaft 20, joints 23 and 24 for supplying and draining a pressurized fluid are provided. The joints 23 and 24 are connected to a not shown pressurized fluid source via a not shown electromagnetic valve so as to be selectively switched by the electromagnetic valve. Thus, the pressurized fluid is supplied to one of the joints 23 and 24.

On the outside of the stepped shaft 20, the cylinder 17 having inner diameter substantially equal to the outer diameter of the larger diameter portion of the stepped shaft 20 is fitted. On the side portions in the axial direction of the cylinder 17, sleeves 26 and 27 are mounted. Respective sleeves 26 and 27 are provided with sealing means 25 for contacting with the inner peripheral surface of the cylinder 17, on the outer peripheral surface thereof. Also the sleeves 26 and 27 are provided with sealing means 28 contacting with the outer peripheral surface of the smaller diameter portions of the stepped shaft 20, on the inner peripheral surface thereof. The inside of the cylinder 17 is divided into two sealed chambers 41 and 42 across the center portion of the larger diameter portion of the stepped shaft 20 by the sealing means 19, 25 and 28.

On the upper surface of the outer periphery of the cylinder 17, a groove 18 extending obliquely with respect to the axis of the fountain roller 2 is provided with an arbitrary angle. The pin 15 mounted on the guide plate 14 is movably inserted into the groove 18 for movement therealong.

On the brackets 21 and 22 fixedly mounted on both sides of the stepped shaft 20, threaded holes extending through these brackets 21 and 22 are provided. Into the threaded holes, threaded shafts 29 and 30 are engaged in a direction toward the end faces of the sleeves 26 and 27 fixed to the cylinder 17. Projecting lengths of respective threaded shafts 29 and 30 from the end surface of the brackets 21 and 22 are set arbitrarily. As will be explained later, these threaded shafts 29 and 30 serve as stoppers for abutting with the sleeves 26 and 27 opposing to one of the threaded shafts 29 and 30 and whereby stopping movement of the cylinder 17, when the cylinder 17 is moved. Namely, shifting stroke of the cylinder 17 is determined by the positions of the tip ends of the threaded shafts 29 and 30. The stopping position of the cylinder 17 is set by the projecting lengths of the threaded shafts 29 and 30.

On the other hand, on one of the sleeve 27, a guide shaft 31 is mounted in the same direction as the stepped shaft 20. The guide shaft 31 is displaceably inserted into a through hole provided in one of the brackets 22, and will be a guide for parallel displacement of the cylinder and a whirl-stop, as will be discussed later.

While an inclining direction of the groove 18 in the driving means 7 is not specified, in the embodiment shown in FIG. 2, when the cylinder 17 causes parallel displacement toward left, the pin 15 is shifted on the side of the fountain roller 2, when the cylinder 17 is displaced in parallel toward right, the pin 15 is shifted away from the fountain roller 2. Accordingly, when the cylinder is shifted toward left, the movable blade 6 moves in a direction where a tip end moves toward the peripheral surface of the fountain roller 2. When the cylinder 17 is shifted toward right, the movable blade 6 is shifted in a direction away from the fountain roller 2.

The guide means 8 provided between the movable blade 6 and the base 3 is constructed with a movable member 32

(slide unit of Japan Thomson K. K., for example) provided at a plurality of positions on the lower surface of the movable blade 6, and a rail 33 (track rail of Japan Thomson K. K., for example) guiding the movable member 32 provided on the upper surface of the base 3 and aligned with the movable member 32, as shown in FIGS. 1, 2 and 4. With this construction, the movable blade 6 can move smoothly in parallel with the peripheral surface of the fountain roller, without strain.

An auxiliary means 34 provided between the movable blade 6 and the base plate 5, is provided with brackets 36 on a plurality of positions on the lower surface of the base plate 5, and is provided with other brackets 35 on the lower surface of the movable blade 6 on a common axis perpendicular to the peripheral surface of the fountain roller 2. Also in both of the brackets 35 and 36, coaxially aligned through holes are provided to pass a bolt 37 therethrough. A nut 39 is engaged to the tip end of the bolt 37. Between the nut 39 and the bracket 36, a compression spring 38 is interposed. By a reaction force of the compression spring 38, the movable blade 6 is constantly exerted a biasing force on a direction away from the peripheral surface of the fountain roller 2 via bolt 37 and bracket 35. The reaction force of the compression spring 38 is arbitrarily adjustable by degree of tightening of the nut 39. It should be noted that the auxiliary means 34 may achieve the similar function when the compression spring 38 is interposed between the other bracket 35 and the head of the bolt 37.

Respective guide means 8 and the auxiliary means 34 are arranged at symmetrical positions on both sides of the driving means 7.

FIGS. 6 and 7 show another embodiment of the ink supply unit 1 according to the present invention. In the shown embodiment, on a tip end portion of an upper side of a movable base 51 performing the same action as the movable blade 6 in the former embodiment, a plurality of tip end blades 50 of a shape complementary with a recess formed on upper surface of the movable base 51 to lie the upper surfaces thereof flush with the upper surface of the movable base 51 for dividing the tip end portion of a blade which defines a first gap 11 together with the peripheral surface of the fountain roller 2, in a direction between both side plates 4. For making it possible to adjust contact condition between the tip ends and the peripheral surface of the fountain roller 2, each tip end blade 50 is fixed for slight movement in shifting direction of the movable base 51. The bottom plate 9 covers over the upper surfaces of the movable base 51 and the tip end blades 50.

As set forth above, the movable base 51 in the shown embodiment performs the same action as that of the movable blade 6 of the first embodiment, and thus is coupled with the driving means 7 via the guide plate 14. Also, the movable blade 51 is coupled with the guide means 8 and the auxiliary means 34 to be movable between a position where the tip end blades 50 contact with the peripheral surface of the fountain roller 2 and a position where the tip end blades 50 is sufficiently distanced from the peripheral surface of the fountain roller 2 for sufficiently opening the first gap, integrally with the tip end blades 50.

In the discussion of the foregoing embodiments, discussion has been given for the embodiments where one driving means 7 is provided. Needless to say, it is also possible to provide a plurality of driving means 7 in alignment along the longitudinal direction of the movable blade 6 and the movable base 51, and more preferably at symmetrical positions of the center portion in the longitudinal direction.

Next, discussion will be given for operation of the foregoing first embodiment of the ink supply unit 1 according to the present invention. During printing operation, the first gap 11 between the movable blade 6 and the fountain roller 2 is held open, and during interruption of the printing operation, the first gap 11 is closed. Opening and closing of the first gap 11 is performed by operating the driving means 7. The upper portion of the ink supply unit 1 is opened to store an ink 10 (hereinafter simply referred to as ink) having relatively high viscosity within the groove.

While printing is interrupted, in FIGS. 1, 2 and 3, the not shown electromagnetic valve is switched to supply the pressurized fluid to the joint 23 on the left side. By this, as shown by the arrow in the solid line, the pressurized fluid is discharged into the sealed chamber 41 on the left side of the cylinder 17 for shifting the cylinder 17 toward left. At this time, the fluid in the sealed chamber 42 on the right side is discharged toward the ambient air from a discharge opening of the electromagnetic valve through the joint 24 on the right side. The cylinder 17 shifted toward left is stopped with abutting the sleeve 26 on the left side, fixed thereon, on the tip end of the threaded shaft 29 on the left side. The cylinder 17 at this time is shifted in parallel in the axial direction without rotation as guided by the guide shaft 31.

By movement of the cylinder 17 toward left, the pin 15 inserted into the groove 18 provided in the cylinder 17 is moved in a direction approaching toward the fountain roller 2 according to inclination of the groove 18. The guide plate 14 and the movable blade 6 following motion of the pin 15 are also shifted according to the motion of the pin. Then, the tip end of the movable blade 6 contacts with the peripheral surface of the fountain roller 2 to close the first gap 11.

Next, upon initiation of printing, the movable blade 6 is shifted to a predetermined position away from the fountain roller 2 by operation of the driving means 7 to provide the first gap 11 between the tip end of the movable blade 6 and the fountain roller 2. The ink deposited on the peripheral surface of the fountain roller 2 from the first gap 11 is drawn by rotation of the fountain roller 2. The fountain roller 2 rotates in a direction for displacing the peripheral surface downwardly for closing the opened front end of the ink supply unit 1. It should be noted that, on the lower side of the ink supply unit 1 and the fountain roller 2, the separated water receptacle 40 is provided for receiving the excessive water of the dampening water admixed to the ink 10 separated and dropped upon passing through the first gap 11 and a second gap 13.

Shifting of the movable blade 6 toward the predetermined position by the driving means 7 is performed in the following manner. Namely, by switching of the not shown electromagnetic valve, the pressurized fluid is supplied to the joint 24 on the right side. By this, as shown by the arrow of broken line in FIG. 3, the pressurized fluid is discharged into the sealed chamber 42 on the right side of the cylinder 17 to shift the cylinder 17 toward right. At this time, the fluid in the sealed chamber 41 on the left side, is discharged to the ambient air through the discharge opening of the electromagnetic valve through the joint 23 on the left side. The cylinder 17 shifted toward right is stopped by abutting the tip end of the sleeve 27 fixed on the right side of the cylinder 17, onto the tip end of the threaded shaft 30 on the right side. At this time, the cylinder 17 is moved in the axial direction without rotation as guided by the guide shaft 31.

By movement of the cylinder toward right, the pin 15 is inserted into the groove 18 provided on the cylinder 17 is shifted in a direction away from the fountain roller 2 according to inclination of the groove 18. The guide plate 14 and the movable blade 6 are similarly shifted according to motion of the pin 15 to move the tip end of the movable blade 6 away from the peripheral surface of the fountain roller 2 to be placed at a predetermined set position so that the first gap 11 is sufficiently opened for permitting ink supply for printing operation.

A plurality of guide means 8, each constituted of the rail 33 and the movable member 32 move toward and away from the peripheral surface of the fountain roller 2 by the driving means 7. Then, the movable members 32, provided respectively on the rails 33 in a condition having no play, are moved in parallel along the axes of the rails 33. The movable blade 6 of integral force having a wide distance between both side plates 4 of the ink supply unit 1, is reciprocally moved smoothly in a condition maintaining parallelism with the peripheral surface of the fountain roller 2.

On the other hand, a plurality of auxiliary means 34 are pulled constantly in a direction away from the peripheral surface of the fountain roller 2 via the bolt 37 by the reaction forces of respective compression springs 38. The pin 15 connected to the movable blade 6 is placed in a condition constantly contacting on one of the inner side surfaces of the groove 18 on the upper side of the outer peripheral surface of the cylinder 17 of the driving means 7, namely the inner side surface on the side placed away from the peripheral surface of the fountain roller 2. Accordingly, by operation of the driving means 7, the pin 15 is positioned with respect to the fountain roller 2 by one of the inner side surfaces of the groove 18 either upon shifting the movable blade 6 or at the stopped condition. Thus, the position of the movable blade 6 coupled with the pin 15 via the guide plate 14 is constantly stabilized.

As the moving means 7 shifting the movable blade 6, the groove 18 extending obliquely relative to the axis of the fountain roller 2, is provided on the peripheral surface of the cylinder 17 which moves in the parallel direction with the axis of the fountain roller. Into the groove 18, the pin 15 fixed on the side of the movable blade 6 is inserted for moving the movable blade 6 toward and away from the peripheral surface of the fountain roller by cam action of the groove 18 and the pin 15 according to movement of the cylinder 17. With this construction, small stroke of the movable blade 6 can be accurately performed with simple construction.

It should be noted that the inclining direction of the groove 18 provided on the outer peripheral surface of the cylinder 17, is set to approach toward the peripheral surface of the fountain roller 2 according to movement toward left, conversely to the case shown in FIG. 2. On the other hand, as the driving means, discussion has been given for the embodiment using the cylinder 17 actuated by the pressurized fluid. However, the driving means may be electromagnetic type driving means (not shown).

Another embodiment shown in FIGS. 6 and 7 has completely the same construction as the embodiment shown in FIG. 1 except for the fact that a plurality of tip end blades 50 divided in the axial direction of the fountain roller 2 are mounted in slightly movable fashion for adjustment over shifting direction of the movable base 51. Accordingly, except for the fact that a plurality of tip end blades 50 are adjustable of contacting condition with respect to the peripheral surface of the fountain roller 2, respectively, and after adjustment, they can be fixed on the movable base 51, another embodiment of the ink supply unit performs the same operation as that of the embodiment shown in FIG. 1.

In the shown embodiment, respective contacting conditions of a plurality of tip end blades 50 with respect to the peripheral surface of the fountain roller 2 can be adjusted corresponding to deformation, such as deflection or so forth of the fountain roller 2. Therefore, good contact condition can be established between the peripheral surface of the fountain roller 2 and the tip end blades 50 to certainly and satisfactorily prevent leakage of the ink 10 stored in the ink supply unit 1.

On the other hand, since supplying and discharging the pressurized fluid to be supplied to the driving means is switched upon selection by the electromagnetic valve, it becomes possible to perform selection by remote control.

As set forth above, by implementation of the present invention, leakage of the ink stored in the ink supply unit during interruption of printing can be successfully prevented, and whereby wasting of ink due to leakage of the ink and contamination of environment due to leakage of the ink can be prevented. Furthermore, work load for cleaning can be reduced. Furthermore, mechanism and operation of the arrangement for preventing leakage of the ink becomes quite simple to significantly lower frequency of occurrence of failure. Furthermore, maintenance can be simple and easy. In addition, the driving means of the movable blade can be operated by remote control to provide the ink supply unit of the keyless printing press with simple in operation. On the other hand, the movable blade forming the gap for supplying the ink according to rotation of the fountain roller, can be shifted by guide means smoothly without strain with respect to the peripheral surface of the fountain roller.

Also, leakage of the ink from the ink supply unit upon interruption of printing can be prevented more satisfactory.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An ink supply unit of a keyless printing press, adapted for use with a relatively high viscosity ink, the ink supply unit having an opening in an upper portion and a front portion thereof, and having side plates, a base and a fountain roller located in said front portion, the fountain roller having a peripheral surface, the fountain roller rotating while displacing the peripheral surface in a downward direction with respect to the ink, the ink supply unit comprising:

a movable base interposed between said side plates and being in integral form, said movable base being inclined and descending toward a tip end side thereof, said movable base being supported on said first mentioned base for movement toward and away from said peripheral surface of said fountain roller;

driving means for driving said movable base between a first position where the tip end of said movable base contacts said peripheral surface of said fountain roller to prevent release of ink to the peripheral surface of the fountain roller and a predetermined second position where said tip end of said movable base is distally located with respect to said peripheral surface of said fountain roller to permit release of ink to the peripheral surface of the fountain roller;

guide means coupled to said movable base, said guide means guiding said movable base so that said tip end of said movable base moves with respect to said peripheral surface of said fountain roller while maintaining a predetermined attitude; and a tip end blade which includes a plurality of members divided in an alignment direction of the both side plates, said tip end blade being mounted on said movable base by placing the tip ends of respective members in opposition to said peripheral surface of said fountain roller, and said tip ends of said respective members being independently adjustable of a contacting condition between the tip ends thereof and said peripheral surface of said fountain roller.

2. An ink supply unit of a keyless printing press as set forth in claim 1, which further comprises auxiliary means coupled to said movable base for biasing said movable base in one moving direction thereof, for stabilizing the position of said tip end of said tip end blades mounted on the movable base with respect to the peripheral surface of said fountain roller.

* * * * *